US010426286B2

(12) United States Patent
Vigil et al.

(10) Patent No.: US 10,426,286 B2
(45) Date of Patent: Oct. 1, 2019

(54) INTERIOR DISPLAY HANGING ORNAMENT

(71) Applicants: Richard Vigil, Lakewood, CO (US); Mary Vigil, Lakewood, CO (US)

(72) Inventors: Richard Vigil, Lakewood, CO (US); Mary Vigil, Lakewood, CO (US)

(73) Assignees: Rich Vigil, Lakewood, CO (US); Mary Vigil, Lakewood, CO (US)

( * ) Notice: Subject to any disclaimer, the term of this patent is extended or adjusted under 35 U.S.C. 154(b) by 387 days.

(21) Appl. No.: 15/340,505

(22) Filed: Nov. 1, 2016

(65) Prior Publication Data

US 2018/0116436 A1 May 3, 2018

(51) Int. Cl.
*A47G 33/00* (2006.01)
*A47G 33/08* (2006.01)

(52) U.S. Cl.
CPC ..... *A47G 33/00* (2013.01); *A47G 33/08* (2013.01)

(58) Field of Classification Search
CPC ..... A47G 33/00; A47G 33/08
USPC ..... 428/7, 11
See application file for complete search history.

(56) References Cited

U.S. PATENT DOCUMENTS 4,542,676 A * 9/1985 Carlson ..... A47G 33/0818 428/11
6,053,322 A * 4/2000 Kim ..... B44D 2/002 206/1.7
6,399,167 B1 * 6/2002 Lewis, Jr. ..... A47G 33/08 428/11

* cited by examiner

*Primary Examiner* — Mark Ruthkosky
*Assistant Examiner* — Julia L Rummel

(57) ABSTRACT

An interior display hanging ornament can have an ornament body with a comparatively large access port which allows mementos to be inserted therethrough, a removably attached port cap, a cap release actuator, and a dual hanger loop. The ornament body can be a bulb or other three-dimensional body having an interior space that can hold therein a plurality of mementos. Examples of such mementos include: photographs, shoulder patches, first home keys, post-cards, teaspoons, etc. At least a portion of the body should be transparent. A removably attached port cap can seal the access port. A cap release actuator allows a person to remove the port cap and access the interior of the ornament body. A dual hanger loop can be attached to the port cap to provide an upper loop from which to hang the ornament. A lower loop portion can suspend mementos within the ornament body.

2 Claims, 9 Drawing Sheets

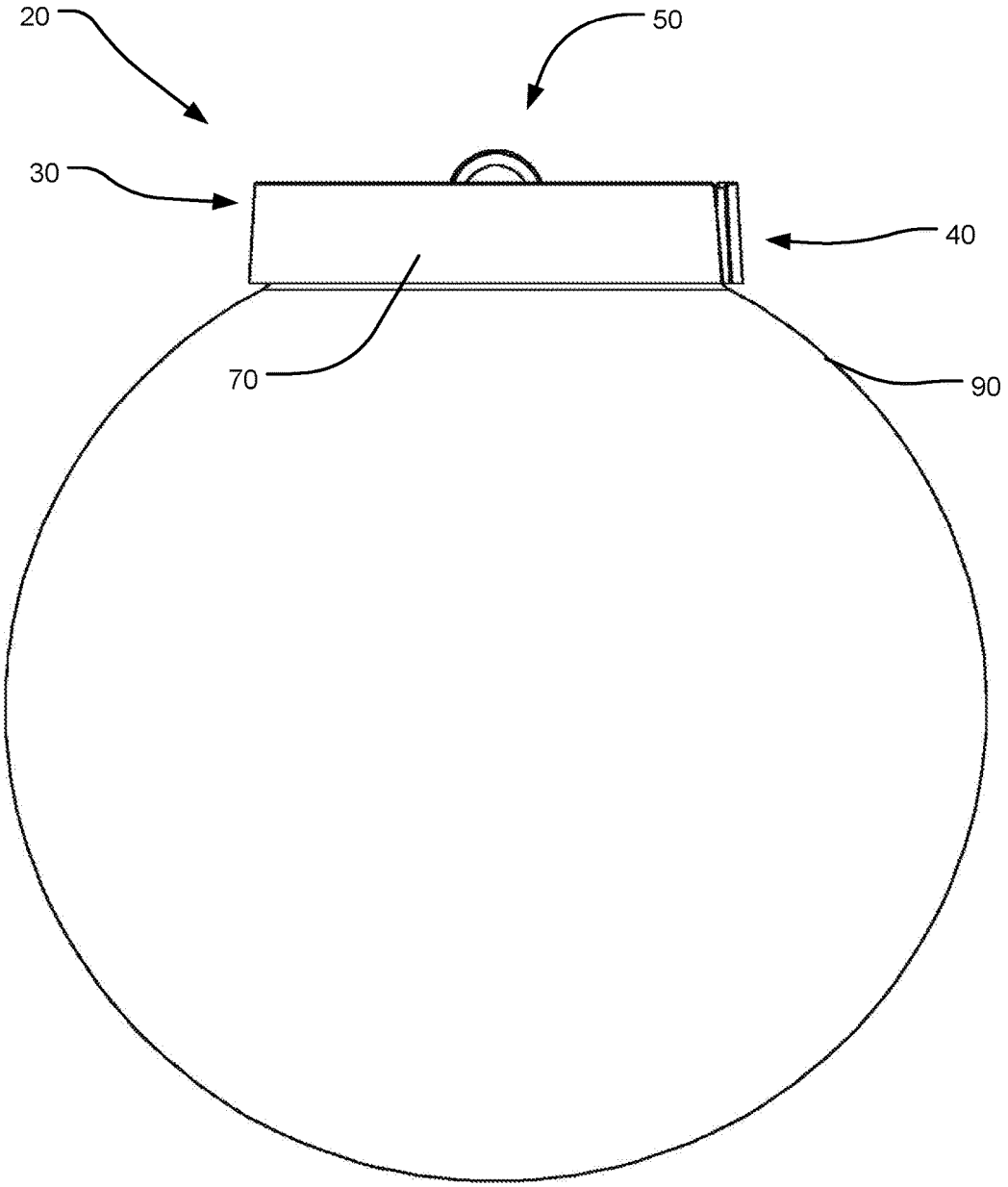
FIG. 2
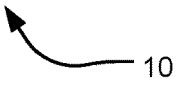

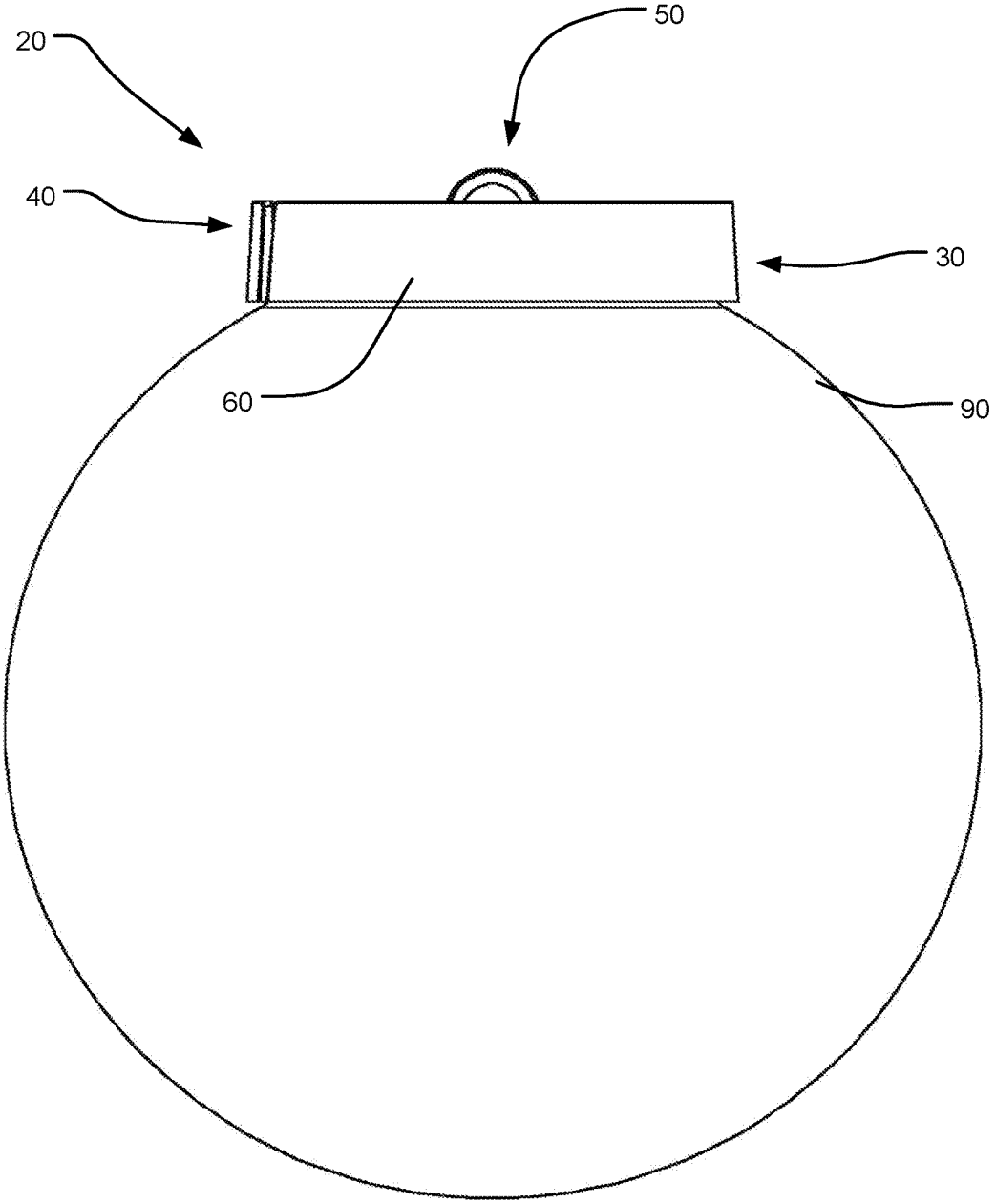
FIG. 3
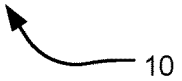

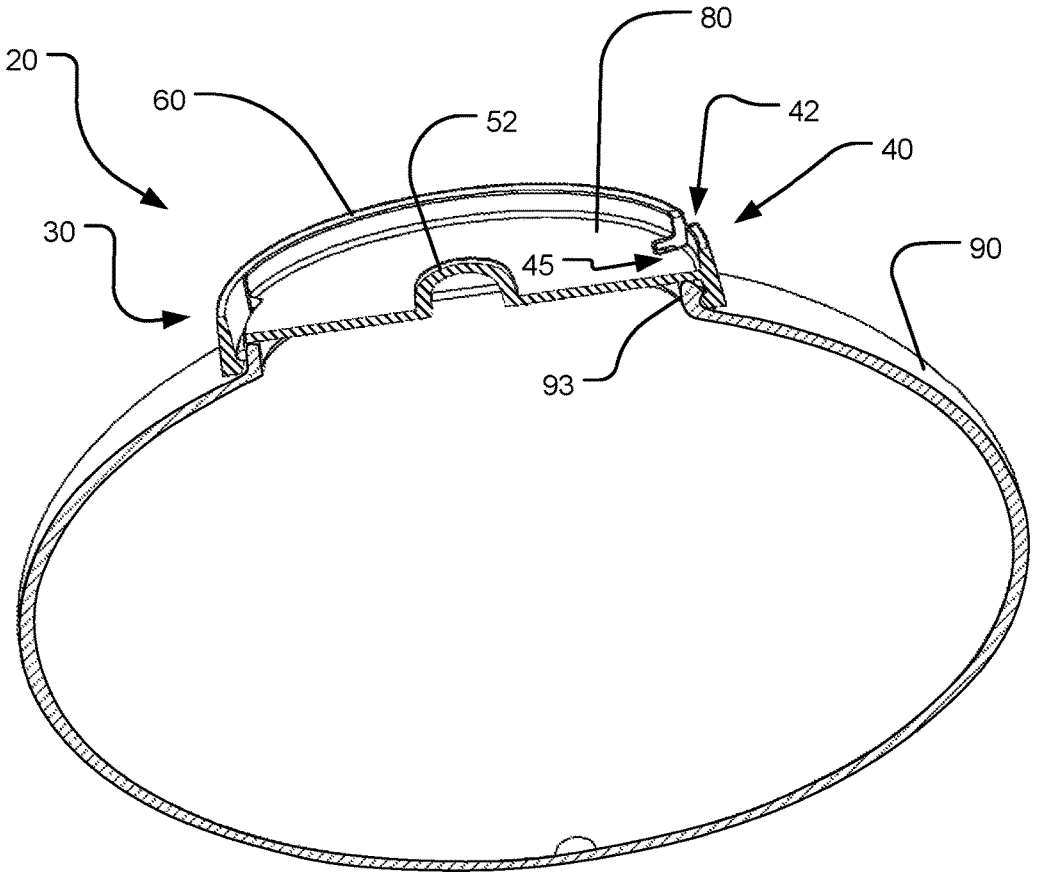
FIG. 9
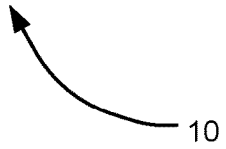

INTERIOR DISPLAY HANGING ORNAMENT

TECHNICAL FIELD

The present invention relates generally to the field of decorating; more particularly, to display ornaments; and more particularly still, to an interior display hanging ornament that can display an item within its interior.

BACKGROUND

Human beings have been decorating our homes since we lived in rock caves and hide tents. As shelters transitioned from communal to individual or family-unit based, further decoration and personalization became possible. Most such decorations and personalizations were then created and utilized by individuals, as the vast commercial markets of today and the excess resources necessary to acquire such items through commerce did not then generally exist. In more recent times, with the commercialization of cultural holidays and home décor, ornaments, streamers, decorations, artwork, ribbons, and other associated accoutrements have grown in commercial availability and variety.

However, because today's mass-commerce is based on producing and selling large numbers of copies of each item, the personalization and uniqueness of home decorations and ornamentation has dwindled. Furthermore, many small personal mementos languish in drawers, boxes, or other out-of-sight storage locations since there exist few, if any, convenient ways to display such items. What is needed are customizable ornaments that can display these personal mementos, thereby allowing each person to customize and personalize their home décor and decorations.

SUMMARY

One embodiment of the present invention can comprise an ornament body having a comparatively large access port adapted to allow mementos to be inserted and removed therethrough, a removably attached port cap, a cap release actuator, and a dual hanger loop. The ornament body comprises a bulb or other three-dimensional body having an interior space adapted to hold therein a plurality of mementos. Examples of such mementos can include, but are not limited to: photographs, shoulder patches, first home keys, themed collections of miniature items, post-cards, tea spoons, religious icons/symbols, etc. In order for mementos placed within the ornament body to be viewable, at least a portion of the body should be transparent and/or translucent. Mementos can be inserted within the ornament body through the relatively large access port usually located on the top of the ornament body. A removably attached port cap seals the access port. The port cap can be released from the access port via manipulation of a cap release actuator that allows a person to remove the port cap and access the interior of the ornament body. A dual hanger loop can be integrated into or attached to the removably attached port cap to provide for a location from which to hang the interior display hanging ornament via a cord, string, hook, etc. or directly from the upper loop portion of the dual hanger loop. Furthermore, the lower loop portion of the dual hanger loop can be used to suspend or otherwise position the plurality of mementos within the ornament body.

BRIEF DESCRIPTION OF THE DRAWINGS

The aforementioned and other features and objects of the present invention and the manner of attaining them will become more apparent and the invention itself will be best understood by reference to the following descriptions of a preferred embodiment and other embodiments taken in conjunction with the accompanying drawings, wherein:

FIG. 2 illustrates a front elevation view of an exemplary embodiment of an interior display hanging ornament;

FIG. 3 illustrates a rear elevation view of an exemplary embodiment of an interior display hanging ornament;

FIG. 9 illustrates a cross-section of a top perspective view of an exemplary embodiment of an interior display hanging ornament.

DETAILED DESCRIPTION

Figure 1:
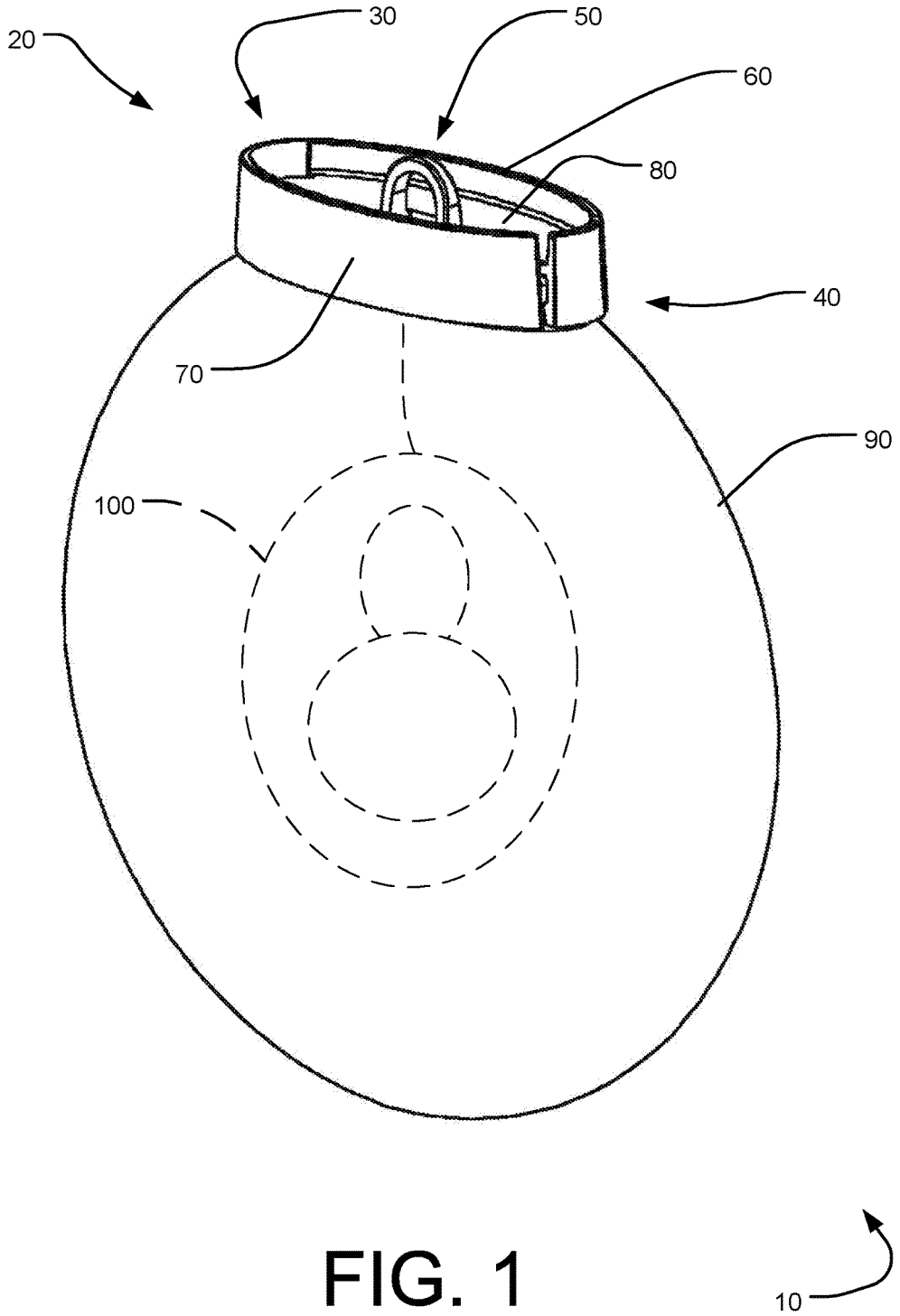
FIG. 1 illustrates a front top perspective view of an exemplary embodiment of an interior display hanging ornament.

Referring now to the drawings, FIG. 1 illustrates a front top perspective view of an exemplary embodiment of an interior display hanging ornament 10, comprising: an ornament body 90 having a comparatively large access port (not visible in FIG. 1, see FIG. 8B, item 91) adapted to allow a plurality of mementos 100 to be inserted and removed therethrough, a removably attached port cap 20, a cap release actuator 40, and a dual hanger loop 50.

The ornament body 90 comprises a bulb or other three-dimensional body having an interior space adapted to hold therein a plurality of mementos 100. In order for mementos placed within the ornament body to be viewable, at least a portion of the body should be transparent and/or translucent. The ornament body 90 can be lens-shaped, much like an oblate spheroid tilted so that the axis of its poles is facing the viewer. In other embodiments, other variations can be utilized.

Mementos can be inserted within the ornament body 90 through the comparatively large access port 91 (see FIG. 8B) usually located on the top of the ornament body 90. A removably attached port cap 20 can seal the access port 91. The port cap 20 can be released from the access port via manipulation of a cap release actuator 40 that allows a person to remove the port cap 20 and access the interior of the ornament body 90. Opposite the cap release actuator portion 40 of the port cap 20 is a port lip grip portion 30. The port lip grip 30 engages the port lip 93 (not shown in FIG. 1, see FIG. 8B, item 93) and works in combination with the cap release actuator 40 to securely hold the port cap 20 in place on the access port 91 until released.

The port cap 20 can also have a front cap wall 70 and a rear cap wall 60. The front and rear cap walls 70 and 60 can be designed to match the appearance of the cap release actuator 40 and the port lip grip 30 so as to enhance the aesthetic appeal of the removably attached port cap 20. The cap walls 70 and 60 also serve to retain the cap release actuator 40 and the port lip grip 30 in place so that they can properly engage the port lip 93 to secure the port cap 20 in place. In another embodiment, one or more portions of one or both of the cap walls 60 and 70 can also engage the port lip 93.

A dual hanger loop 50 can be integrated into or attached to the removably attached port cap 20 to provide for a location from which to hang the interior display hanging ornament 10 via a cord, string, hook, etc. Alternatively, the interior display hanging ornament 10 can be hung directly from the top loop portion (item 52, see FIG. 7A) of the dual hanger loop 50. Furthermore, the lower loop portion (item 55, see FIG. 7A) of the dual hanger loop can be used to suspend or otherwise position the plurality of mementos 100 within the ornament body. For more information about the lower portion of the dual hanger loop, see FIGS. 7A-B, item 55. The dual hanger loop 50 protrudes from the top surface of the port cap lid 80. It can be integrated into the port cap lid 80 or otherwise attached thereto. In another embodiment, the dual hanger loop 50 can attach to the port cap 20 in another location(s). For example, one leg of the upper portion of the dual hanger loop 50 could attach to the cap release actuator 40 and another leg could attach to the port lip grip 30. This arrangement has the added benefit of providing a spring action pushing the tops of the actuator 40 and grip 30 outwards, thereby forcing the bottoms of the cap release actuator 40 and the port lip grip 30 to engage the port lip 93.

FIG. 2 illustrates a front elevation view of an exemplary embodiment of an interior display hanging ornament 10. An ornament body 90 is illustrated with a removably attached port cap 20, a cap release actuator 40, a port lip grip 30, and a dual hanger loop 50. From this viewing angle, it is apparent that the shape of the ornament body 90 in this embodiment is approximately a circle when viewed from the front. In other embodiments, the shape can differ. However, this shape provides a relatively wide front and back viewing window with minimal distortion caused by the curved shape of the material comprising the ornament body 90. See FIGS. 4 and 5 for examples of the shapes of the sides of exemplary ornament bodies 90 given side views.

The interior display hanging ornament can be hung up from a Christmas tree, a window frame, a keepsakes box, or any other suitable location by the dual hanger loop 50. The removably attached port cap 20 can secure the dual hanger loop 50 to the ornament body 90. The port lip grip 30 wraps over the port lip 93 (not shown in FIG. 2, see FIG. 8B) on the mouth of the ornament body on one end of the port cap. The opposite end of the port cap 20 can have the cap release actuator 40 which also wraps over the port lip 93 and acts in concert with the port lip grip 30 to releasably retain the port cap 20 on the port lip 93 of the ornament body 90.

FIG. 3 illustrates a rear elevation view of an exemplary embodiment of an interior display hanging ornament 10. An ornament body 90 is illustrated with a removably attached port cap 20, a cap release actuator 40, a front cap wall 70, a rear cap wall 60, and a dual hanger loop 50.

Figure 4:
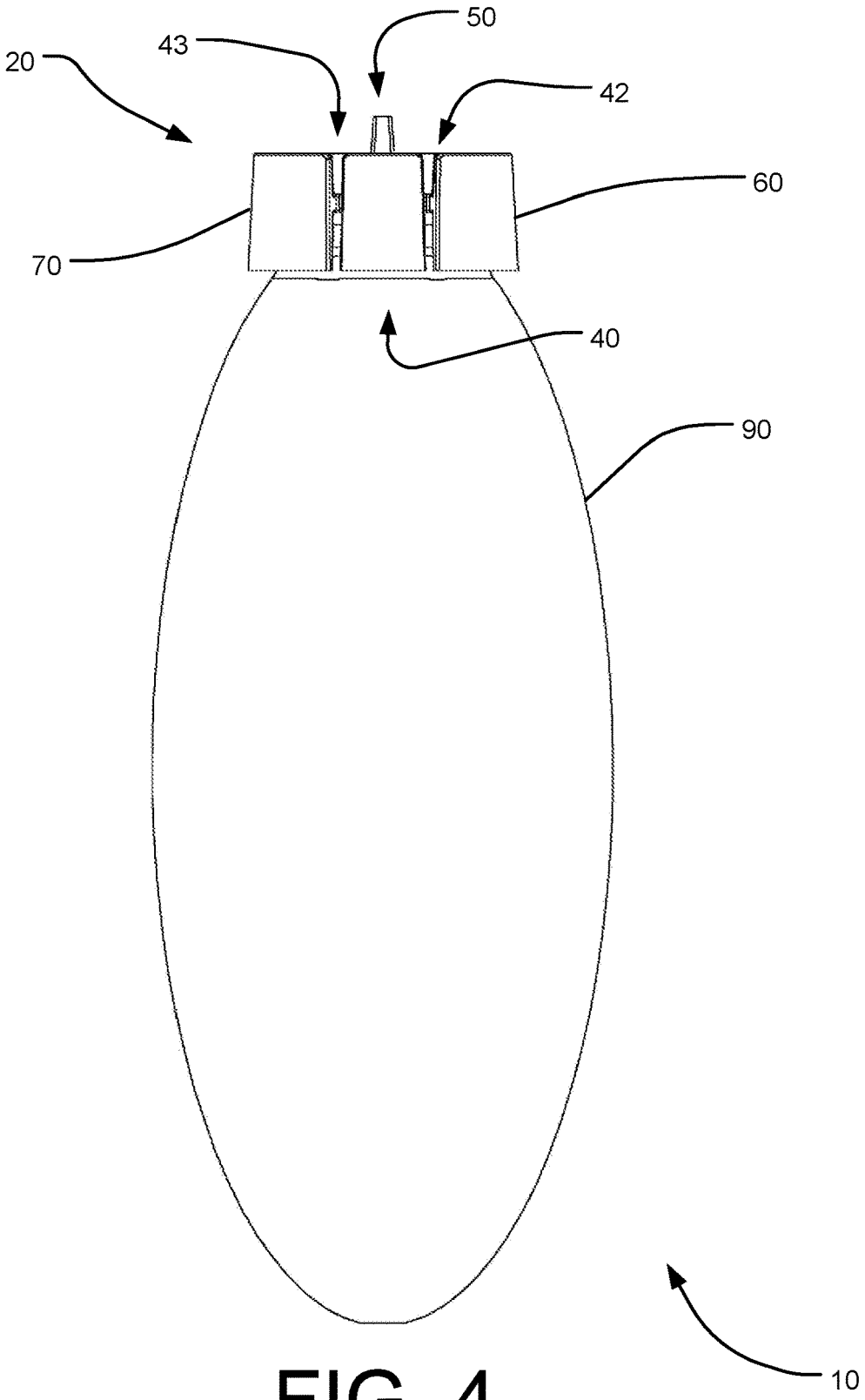
FIG. 4 illustrates a right side elevation view of an exemplary embodiment of an interior display hanging ornament.

FIG. 4 illustrates a right side elevation view of an exemplary embodiment of an interior display hanging ornament 10. An ornament body 90 is illustrated with a removably attached port cap 20, a front cap wall 70, a rear cap wall 60, and a dual hanger loop 50.

The cap release actuator 40 is illustrated with a first movement gap 42 and a second movement gap 43. The movement gaps 42 and 43 allow the cap release actuator 40 to hinge more freely on the port cap lid hinge 45 (not shown in FIG. 3, see FIG. 8A, item 45). In this way, the lower portion of the cap release actuator 40 can be drawn outwards from the port lip 93 by pressing the upper portion of the cap release actuator 40 inwards towards the upper portion of the dual hanger loop 50. See later Figures for more detail.

Figure 5:
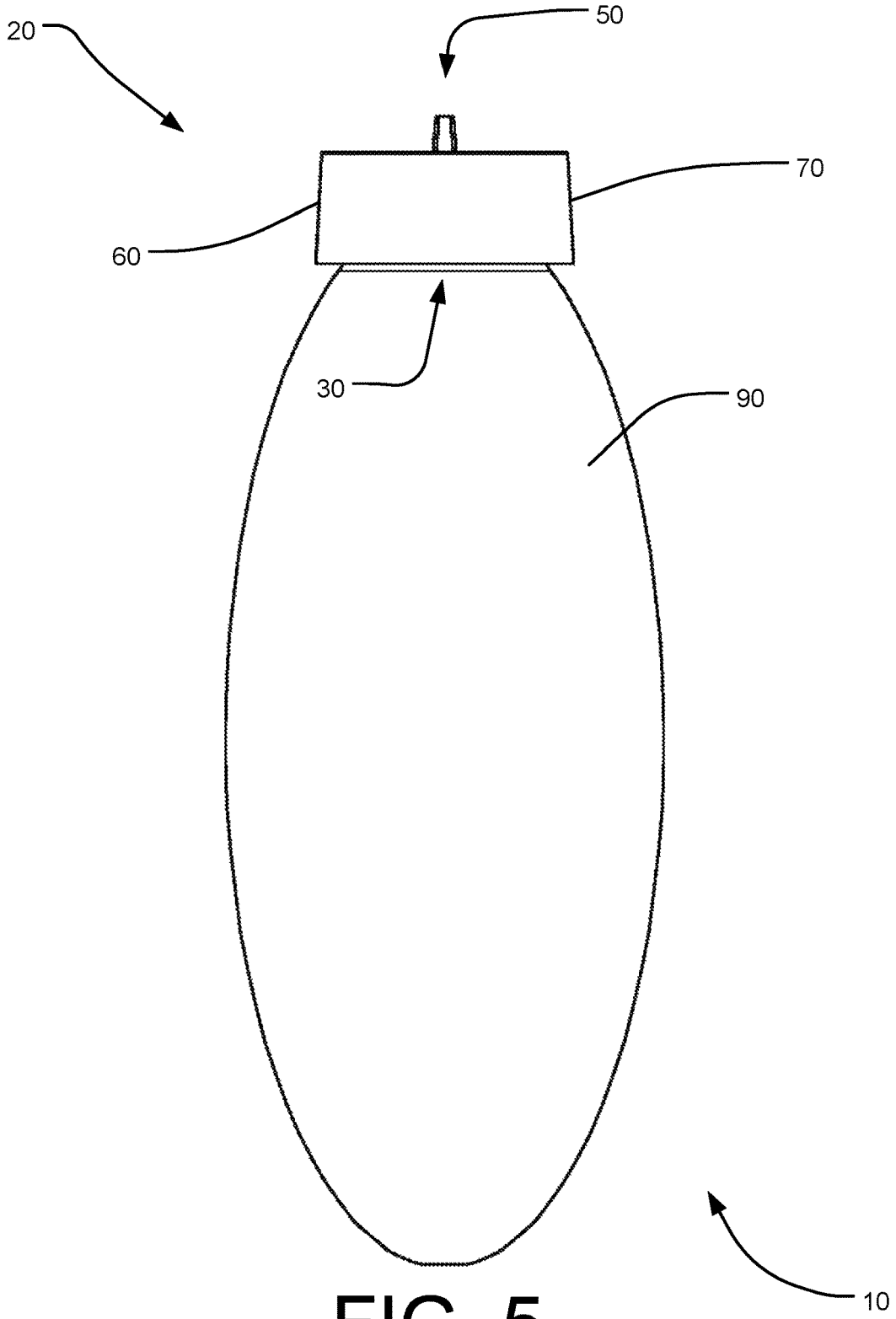
FIG. 5 illustrates a left side elevation view of an exemplary embodiment of an interior display hanging ornament.

FIG. 5 illustrates a left side elevation view of an exemplary embodiment of an interior display hanging ornament 10. An ornament body 90 is illustrated with a removably attached port cap 20, a port lip grip 30, and a dual hanger loop 50.

Figure 6:
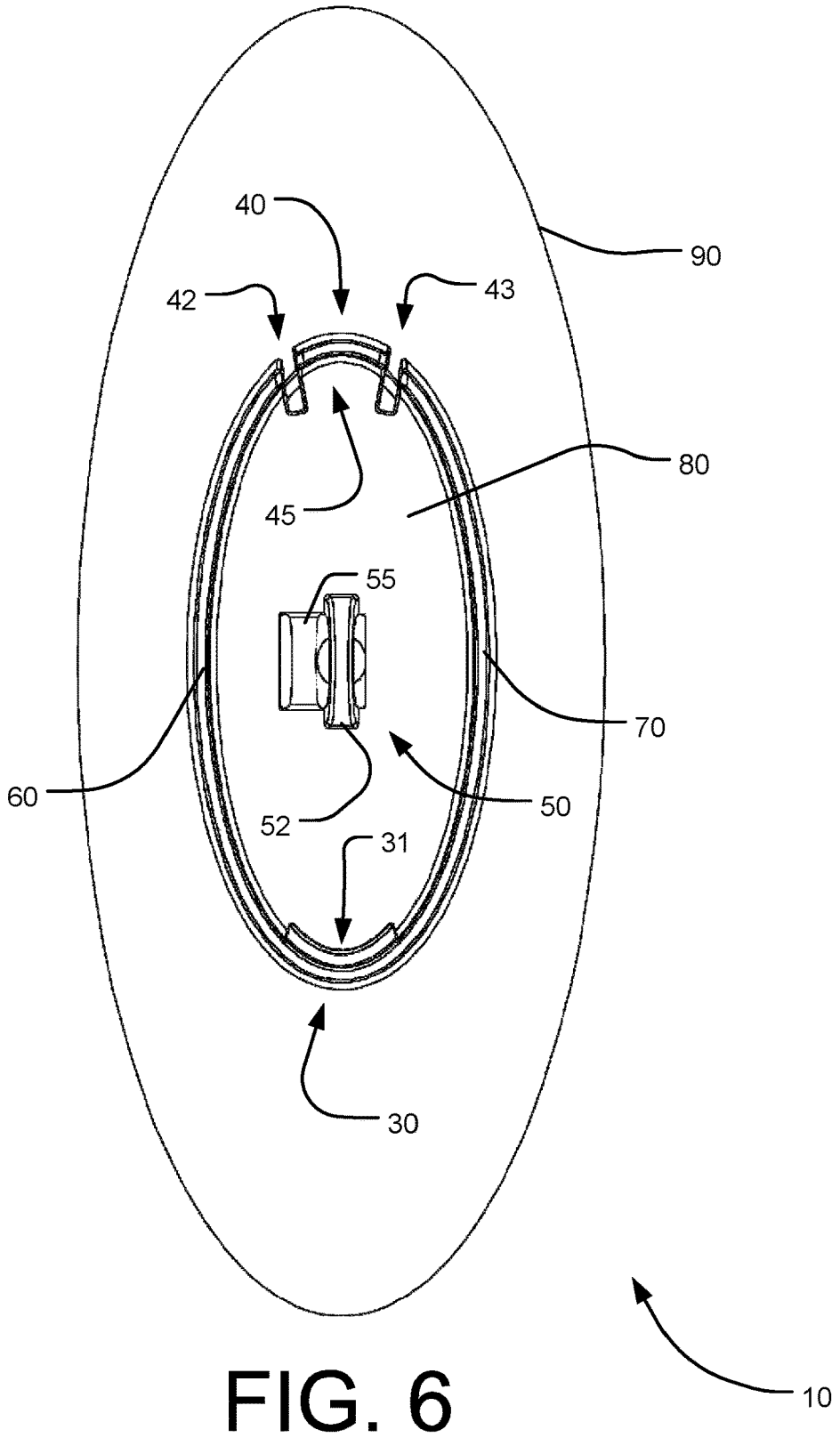
FIG. 6 illustrates a top plan view of an exemplary embodiment of an interior display hanging ornament.

FIG. 6 illustrates a top plan view of an exemplary embodiment of an interior display hanging ornament 10. An ornament body 90 is illustrated with a removably attached port cap 20 having a cap release actuator 40, first and second movement gaps 42 and 43, a front cap wall 70, a rear cap wall 60, a port cap lid 80, a port lip grip 30 having a hinge grip gap 31, and a dual hanger loop 50.

The first and second movement gaps 42 and 43 allow the cap release actuator 40 to hinge more freely on the port cap lid hinge 45. In this way, the lower portion of the cap release actuator 40 can be drawn outwards from the port lip 93 by pressing the upper portion of the cap release actuator 40 inwards towards the upper portion of the dual hanger loop 50. See FIG. 8A for more detail.

The portion of the port lip grip 30 that is most apparent from this viewing perspective is the hinge grip gap 31. In order to reattach a previously removed port cap 20 to the ornament body 90, the port cap 20 is tilted relative to the access port 91 (see FIG. 8B). This allows the port lip grip 30 to first engage the port lip 93 of the mouth without any other portion of the port cap 20 touching the ornament body 90. Once the port lip grip 30 is fully engaged with the port lip 93 and the port lip groove 94 (see FIG. 8B), the remainder of the port cap 20 can be tilted back to level and snapped onto the access port 91. The hinge grip gap 31 allows the port lip grip 30 to flex easily as this hinging movement takes place so that the port lip grip 30 can remain engaged with the ornament body 90 as the remaining portion of the removably attached port cap 20 is pressed downwards onto the access port 91 of the ornament body 90.

Figure 7A:
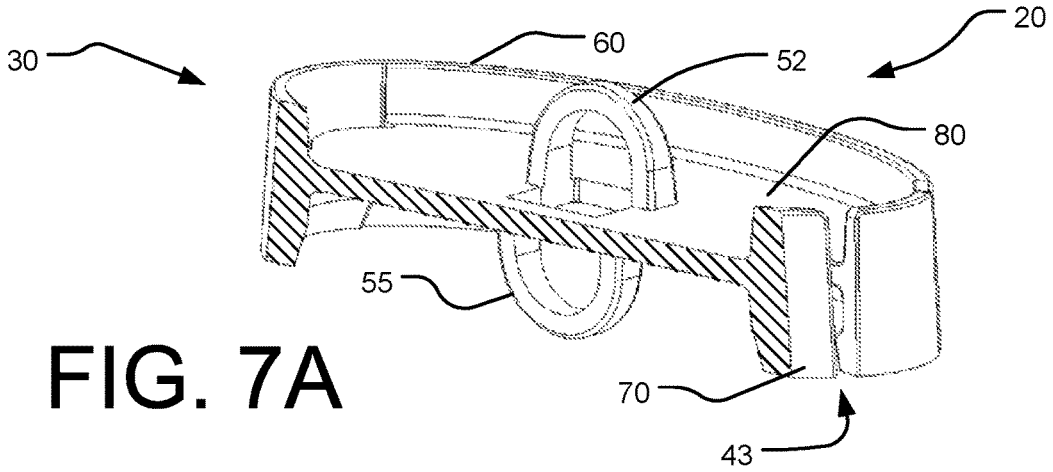
FIG. 7A illustrates a cross-section of a front top perspective view of an exemplary embodiment of an interior display hanging ornament highlighting the removably attached port cap without the ornament body.

FIG. 7A illustrates a cross-section of a front top perspective view of an exemplary embodiment of an interior display hanging ornament highlighting the removably attached port cap 20 without the ornament body. The cross section illustrates the interior functional lines of the front cap wall 70 and how the front cap wall 70 does not necessarily need to have a port lip groove engagement protrusion as can be found on the port lip grip 30 and the cap release actuator 40 (see items 36 and 46 in FIGS. 7B and 8A for exemplary structures) in order to securely hold the port cap 20 onto the ornament body 90.

The interior display hanging ornament 10 can be hung directly from the upper loop portion 52 of the dual hanger loop 50. Furthermore, the lower loop portion 55 of the dual hanger loop can be used to suspend therefrom the plurality of mementos 100 (see FIG. 1) within the ornament body. In the illustration in FIG. 7A, the dual hanger loop 50 is shown as having the upper loop portion 52 offset from the lower loop portion 55. In another embodiment, the upper loop portion 52 and lower loop portion 55 are not offset. Similarly, although there is a hole shown in the port cap lid 80 in FIG. 7A, in some embodiments, no hole need be present near the dual hanger loop 50.

Figure 7B:
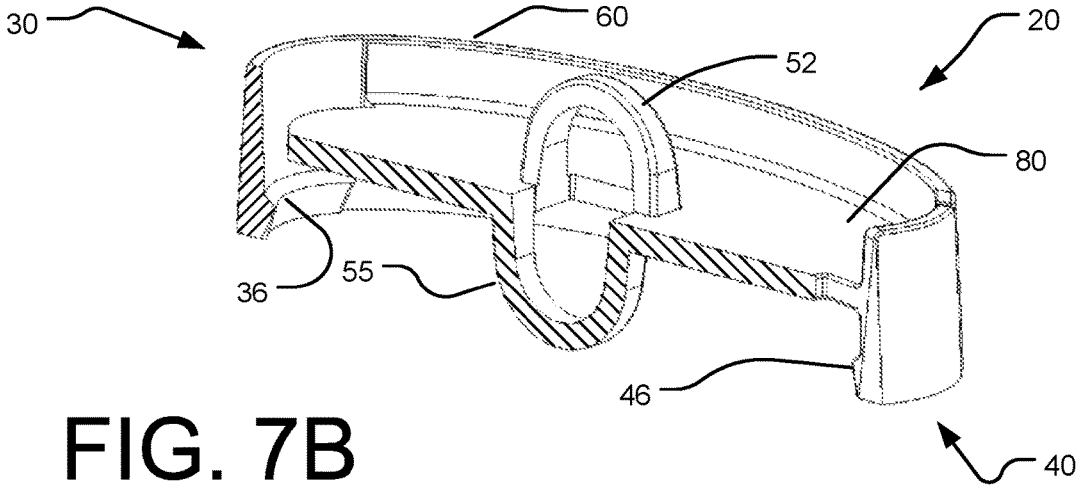
FIG. 7B illustrates a cross-section of a front top perspective view of an exemplary embodiment of an interior display hanging ornament highlighting the removably attached port cap without the ornament body.

FIG. 7B illustrates a cross-section of a front top perspective view of an exemplary embodiment of an interior display hanging ornament highlighting the removably attached port cap 20 without the ornament body. The cross section illustrates the interior functional lines of the port lip grip 30 and the cap release actuator 40. The port lip grip 30 has a first port lip groove engagement protrusion 36 that fits within the port lip groove 94 that is formed between the upper portion of the ornament body 90 and the port lip 93 (see FIG. 8B). This first port lip groove engagement protrusion 36 engages the port lip groove 94 and secures the port lip grip 30 to the large access port 91 of the ornament body 90. Similarly, the cap release actuator 40 has a second port lip groove engagement protrusion 46 that fits within the port lip groove 94 that is formed between the upper portion of the ornament body 90 and the port lip 93 (see FIG. 8B). This second port lip groove engagement protrusion 46 engages the port lip groove 94 and secures the cap release actuator 40 to the large access port 91 of the ornament body 90.

Figure 7C:
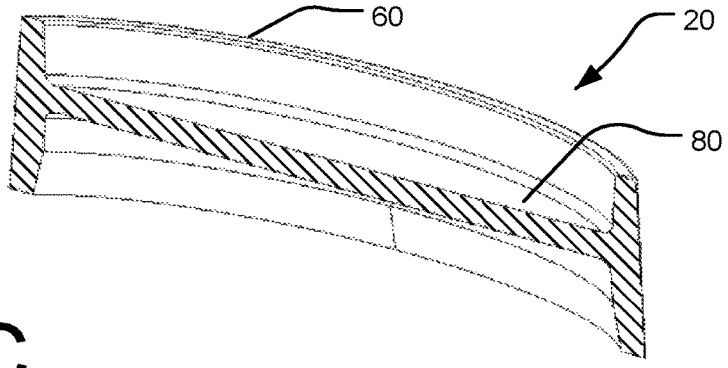
FIG. 7C illustrates a cross-section of a front top perspective view of an exemplary embodiment of an interior display hanging ornament highlighting the removably attached port cap without the ornament body.

FIG. 7C illustrates a cross-section of a front top perspective view of an exemplary embodiment of an interior display hanging ornament highlighting the removably attached port cap 20 without the ornament body. The cross section illustrates the interior functional lines of the rear cap wall 60 and how the rear cap wall 60 does not necessarily need to have a port lip groove engagement protrusion as can be found on the port lip grip 30 and the cap release actuator 40 (see items 36 and 46 in FIGS. 7B and 8A for exemplary structures) in order to securely hold the port cap 20 onto the ornament body 90. However, in other embodiments either or both of the rear cap wall 60 and front cap wall 70 can comprise one or more additional port lip groove engagement protrusions.

Figure 8A:
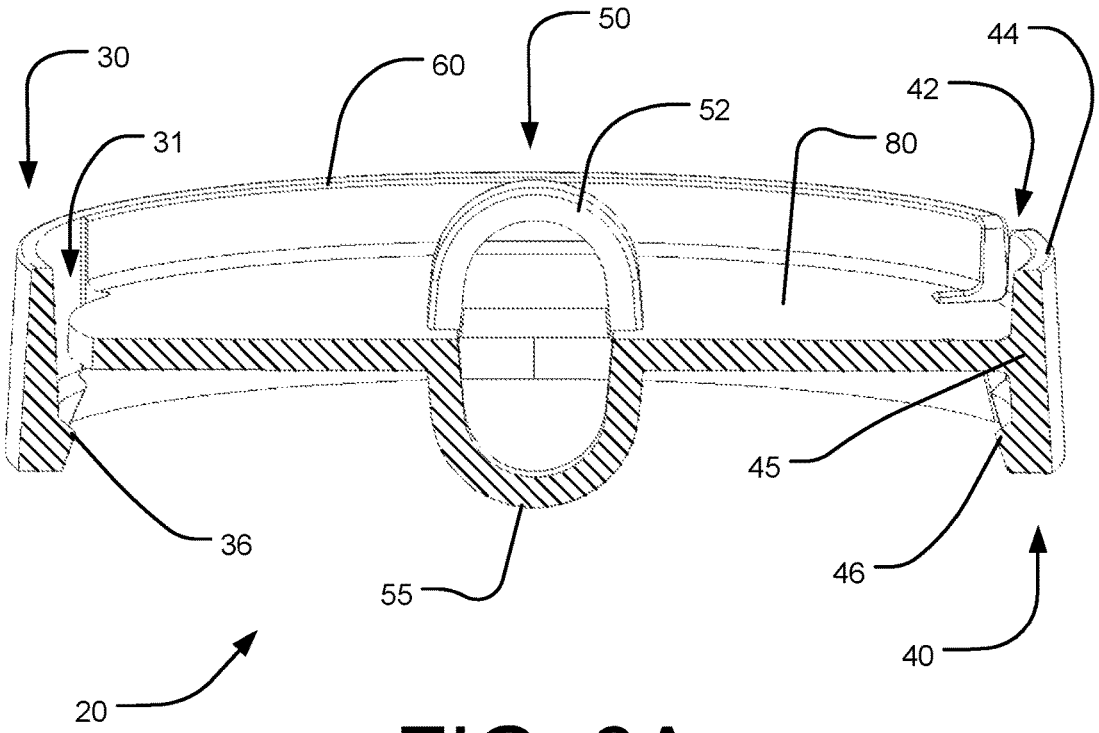
FIG. 8A illustrates a cross-section of a front perspective view of an exemplary embodiment of an interior display hanging ornament highlighting the removably attached port cap without the ornament body.

FIG. 8A illustrates a cross-section of a front perspective view of an exemplary embodiment of an interior display hanging ornament highlighting the removably attached port cap 20 without the ornament body. This view highlights the hinge grip gap 31, the first port lip groove engagement protrusion 36, the second port lip groove engagement protrusion 46, the port cap lid hinge 45, and the cap release actuator upper portion 44. The material(s) comprising the port cap 20, and specifically the port lip grip 30 and cap release actuator 40, should be flexible and resilient to allow the grip 30 and actuator 40 to bend and flex in order to snap the port cap 20 on and off the ornament body 90. It should be apparent from FIGS. 8A and 8B that the protrusions 36 and 46 engage within the port lip groove 94 of the ornament body in order to hold the port cap 20 over the access port 91, effectively controlling access to the interior of the ornament body.

Figure 8B:
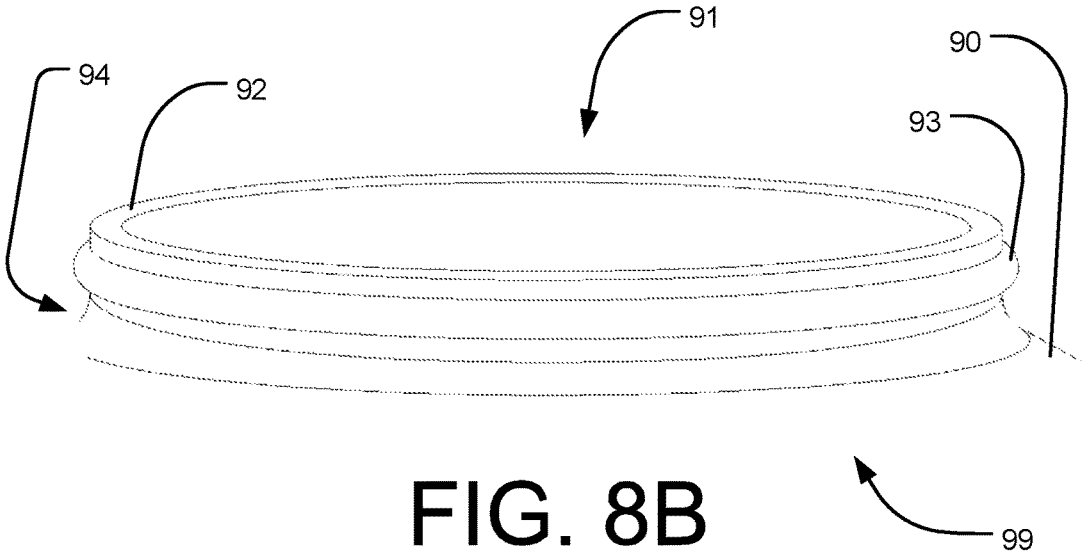
FIG. 8B illustrates a top front perspective view of an exemplary embodiment of an interior display hanging ornament mouth without the removably attached port cap.

FIG. 8B illustrates a top front perspective view of an exemplary embodiment of an interior display hanging ornament mouth 99 without the removably attached port cap. The mouth 99 has an access port 91 in the exemplary embodiment of FIG. 8B. In other embodiments, the access port 91 can have other shapes besides oval. Similarly, the port cap 20, can have other shapes as well without departing from the spirit of the invention. The access port 91 has a rim 92 that defines the topmost portion of the ornament mouth 99. Below the rim 92 is the port lip 93 that extends outwards from the rim 92 and from the ornament body 90. Because the port lip 93 protrudes outwards from the ornament body 90, a port lip groove 94 is formed. In other embodiments, the port lip 93 may not extend beyond the outer diameter of the rim 92. The port lip groove 94 provides a channel for the first port lip groove engagement protrusion 36 and the second port lip groove engagement protrusion 46 to extend into, thereby securing the port cap 20 over the mouth of the ornament body 90.

FIG. 9 illustrates a cross-section of a top perspective view of an exemplary embodiment of an interior display hanging ornament 10. The ornament body 90 and the removably attached port cap 20 are shown in cross-section to help clarify the relationship between the port lip grip portion 30/cap release actuator 40 portions of the port cap 20 and the port lip 93 on the mouth of the ornament body 90. Both of the portions of the port cap 20 engage the port lip 93 and work to releasably secure the ornament body 90 to the port cap 20.

The above specification, examples and data provide a description of the structure and use of exemplary implementations of the described articles of manufacture and methods. It is important to note that many implementations can be made without departing from the spirit and scope of the invention.

What is claimed is:

1. An interior display hanging ornament, comprising: an ornament body having a mouth with an access port;

the access port being large enough to allow a memento to be inserted therethrough and placed in an interior of the ornament body;

the ornament body being at least partially transparent so that an object placed in the interior thereof is visible to an outside observer;

a removably attached port cap attached over the access port and sealing off the interior, the port cap having a port cap lid, a port lip grip, a cap release actuator, a rear cap wall, a front cap wall, a first movement gap, and a second movement gap;

the port lip grip having a first port lip groove engagement protrusion that fits over a port lip on a sidewall of the mouth, the first port lip groove engagement protrusion releasably engaging the port lip groove between the ornament body and the access port to secure the port cap on the ornament body;

the cap release actuator having an upper portion and a lower portion and being attached to the port cap lid via a port cap lid hinge, where the cap release actuator releasably engages the port lip groove between the ornament body and the access port;

the cap release actuator having a second port lip groove engagement protrusion that fits over the port lip on the sidewall of the mouth, the second port lip groove engagement protrusion releasably engaging the port lip groove to secure the port cap on the ornament body;

the rear cap wall and front cap wall extending downwardly from the port cap lid and extending radially between the port lip grip and the cap release actuator respectively along a rear and front surface of the port cap;

the first movement gap and the second movement gap in the port cap separating the cap release actuator respectively from the rear cap wall and the front cap wall; and a dual hanger loop attached to the port cap and having an upper loop portion and a lower loop portion, the upper loop portion having a hole therethrough so that a hanging device can extend through the hole and suspend the interior display hanging ornament thereby, the lower loop portion having a hole therethrough;

wherein the first movement gap and the second movement gap in the port cap facilitate hinging of the cap release actuator on the port cap lid hinge such that the lower portion is drawn outwards from the port lip when the upper portion is pressed inwards towards the upper loop portion.

2. The interior display hanging ornament of claim 1, further comprising:

a hinge grip gap located between the port lip grip and the port cap lid, the hinge grip gap facilitating easy hinging movement of the port lip grip.

* * * * *